United States Patent [19]

Barber et al.

[11] Patent Number: 5,001,312

[45] Date of Patent: Mar. 19, 1991

[54] HIGH CURRENT REPETITIVE SWITCH HAVING NO SIGNIFICANT ARCING

[75] Inventors: John P. Barber; Timothy J. McCormick, both of Dayton, Ohio

[73] Assignee: IAP Research, Inc., Dayton, Ohio

[21] Appl. No.: 309,679

[22] Filed: Feb. 13, 1989

[51] Int. Cl.[5] ..... H01H 33/16

[52] U.S. Cl. ..... 200/144 AP; 220/221

[58] Field of Search ..... 200/144 AP, 144 R; 310/219, 220, 221

[56] References Cited

U.S. PATENT DOCUMENTS

| | | | |
|---|---|---|---|
| 276,233 | 4/1883 | Edison | 310/220 |
| 1,453,410 | 5/1923 | Slepian | 310/220 |
| 1,464,123 | 8/1923 | Whitaker | 310/220 |
| 1,743,682 | 1/1930 | Oswald | 310/248 |
| 2,125,027 | 7/1938 | Kasperowski | 171/325 |
| 3,322,988 | 5/1967 | Ishikawa et al. | 310/220 |
| 3,343,115 | 9/1967 | Greenwood | 200/144 AP |
| 3,381,210 | 4/1968 | Shano et al. | 310/220 |
| 3,456,143 | 7/1969 | Uemura et al. | 310/220 |
| 3,590,300 | 6/1971 | Moberly | 310/248 |
| 4,760,769 | 8/1988 | Jasper, Jr. | 310/12 |
| 4,777,720 | 10/1988 | Maier et al. | 200/292 |

FOREIGN PATENT DOCUMENTS

| | | | |
|---|---|---|---|
| 288195 | 10/1915 | Fed. Rep. of Germany | 200/144 AP |
| 533202 | 9/1931 | Fed. Rep. of Germany | 200/144 AP |

*Primary Examiner*—Robert S. Macon

*Attorney, Agent, or Firm*—Jacox & Meckstroth

[57] ABSTRACT

A high current direct current switch which has no significant arcing and which is capable of high rate repetitive operation. A collector member has a plurality of electrically conductive leaves which are arranged in a stack. All of the leaves in the stack have substantially the same outside area and the same thickness. However, leaves in the stack have various resistance-conductive paths and values. The leaves are arranged progressively so that leaves in the top portion of the stack have greater resistance values than leaves in the lower portion of the stack. The various resistance values are obtained by providing the leaves with openings therethrough which establish resistance-conductive paths through the leaves. Some of the leaves are electrically insulated from all of the other leaves. A rotor is positioned in engagement with the stack of leaves. The rotor is provided with an electrically conductive section and an electrically insulative section. As the rotor rotates the insulative section first engages the leaves of least resistance and then progressively engages the leaves of greater resistance. Thus, as the insulative section of the rotor covers all of the leaves, current between the rotor and the collector member is reduced to zero without significant arcing therebetween.

26 Claims, 2 Drawing Sheets

HIGH CURRENT REPETITIVE SWITCH HAVING NO SIGNIFICANT ARCING

The invention described herein may be manufactured and used by the Government of the United States for all governmental purposes without the payment of any royalty.

BACKGROUND OF THE INVENTION

In some types of electrical circuits it is necessary to repetitively energize and deenergize a portion or all of the circuit by means of a switch. In a direct current circuit of large current magnitude switch opening of the circuit usually results in switch arcing. Of course, switch arcing is objectionable for numerous reasons. For example, deterioration of the switch occurs with arcing in the switch.

The following U.S. Pat. Nos. pertain to attempts to solve the problem of arcing when a switch is opening in a circuit in which large magnitudes of direct current flow: 276,233, 1,743,682, 2,125,027, 3,456,143, 3,590,300, 4,760,769, and 4,777,720. However, none of these patents shows the effective, low-cost progressive conductive-resistive structure of this invention.

It is therefore, an object of this invention to provide switching means which is capable of opening a direct current circuit of large current magnitude without significant arcing.

It is another object of this invention to provide such switching means which is capable of repetitive operation at a relatively high rate.

It is another object of this invention to provide such switching means which can be employed in a brush commutating direct current motor or generator.

Another object of this invention is to provide such switching means which can be constructed in quantities at relatively low cost.

It is another object of this invention to provide such switching means which is long-lived.

Other objects and advantages of this invention reside in the construction of parts, the combination thereof, the method of production and the mode of operation, as will become more apparent from the following description.

SUMMARY OF THE INVENTION

This invention comprises a stationary collector member which is electrically conductive and which is continuously engaged by a moving conductor-insulator member. The moving conductor-insulator member has a major portion which is of electrically conductive material. The moving conductor-insulator member has a smaller portion which is of electrical insulator material. Herein the moving conductor-insulator member is shown as being a rotating conductor-insulator member. However, other types of moving conductor-insulator members may be a part of a high current switch of this invention.

The stationary collector member is positioned between the rotating conductor-insulator member and a stationary conductor member. The stationary collector member is in firm engagement with a stationary conductor member. When the conductive portion of the rotating member is in engagement with the collector member an electrical circuit exists between the rotating member and the stationary conductor member. Thus, the stationary conductor member and the collector member and the rotating member form a portion of an electrical circuit for high current energization of an electrical load. As the rotating conductor-insulator member rotates, the electrical load is energized and deenergized.

The collector member comprises a multiplicity of electrically conductive leaves which are arranged in a stack. All of the leaves in the stack have the same outside dimensions and the same thickness dimension. Each of the leaves has an edge portion in engagement with the rotating conductor-insulator member and an opposite edge portion in engagement with the stationary conductor member. In one section of the collector member each of the leaves is insulated from the other leaves. Therefore, current flow through each leaf in the stack is directly from the rotating conductor-insulator member to the stationary conductor member.

However, the leaves in the stack are formed so that the many different magnitudes of resistance are present in the stack of leaves. As stated, each of the leaves has a current path therethrough from one edge of the leaf to the opposite edge of the leaf. Some of the leaves have cut-out portions which create a very long conductive path for current flow through the leaf, as the current must flow in a very circuitous path from one edge of the leaf to the opposite edge of the leaf. Thus, the resistance to the current flow is maximum in such a leaf in the stack. Other leaves in the stack are formed so that the path for current flow is less circuitous. Thus, in such leaves the resistance to current flow therethrough is less. The leaves are constructed and arranged so that from the bottom of the stack to the top of the stack the current path is progressively greater, and thus the resistive path is progressively greater.

As stated, the peripheral surface of the rotating conductor-insulator member continuously engages the collector member. The major portion of the peripheral surface is a conductor portion, and means are connected to the rotating conductor-insulator member for conducting electrical current through the rotating conductor-insulator member when the conductor portion of the rotating conductor-insulator member is in engagement with the collector member.

A portion of the peripheral surface of the rotating member is an insulator portion. As the rotating conductor-insulator member rotates, the insulator portion thereof moves from the bottom of the stack of leaves to the top of the stack. Thus, the insulator portion of the rotating conductor-insulator member progressively covers the leaves of the collector member. Thus, the magnitude of the current flow through the collector member is progressively reduced as the insulator portion of the conductor-insulator member moves across the collector member. When the insulator portion of the rotating conductor-insulator member completely covers the collector member, the magnitude of current flow between the rotating conductor-insulator member is reduced to zero.

In the circuit shown herein, the switch of this invention is electrically connected in parallel with a load. Therefore, when there is no current flow from the rotating conductor-insulator member all of the current flow in the circuit is through the load.

As stated above, the resistance of the collector member through which the current flows progressively and significantly increases as the insulator portion of the rotating conductor-insulator member covers the leaves of the collector member. Therefore, as the insulator portion of the rotating conductor-insulator member progressively covers the collector member, the current flow in the circuit is gradually shifted or switched from the rotating conductor-insulator member to the resistive load. Such a switch operation occurs without significant arcing between the rotating conductor-insulator member and the collector member.

Due to the fact that large magnitudes of electrical current flow through a collector member of this invention, as repetitive switching operation occurs, cooling of the collector member is necessary. The collector member of this invention includes means for cooling thereof.

DETAILED DESCRIPTION OF THE PREFERRED EMBODIMENT

Figure 4:
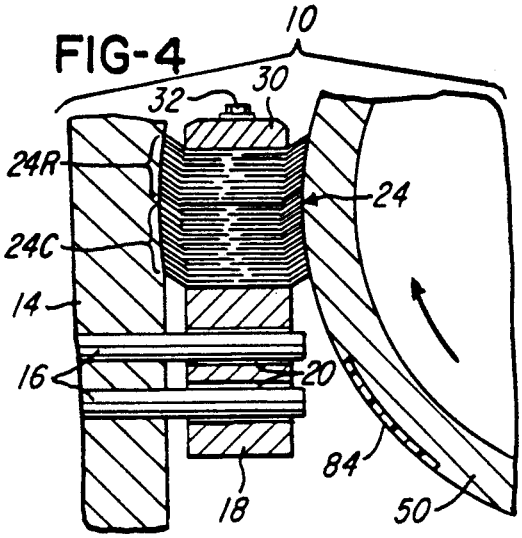
FIG. 4 is a sectional view illustrating the structure of a switch of this invention.
Figure 5:
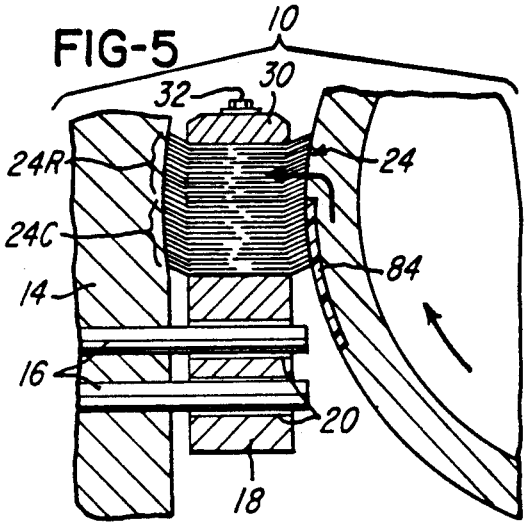
FIG. 5 is a sectional view, similar to FIG. 4, showing the switch of this invention and illustrating current flow therethrough as the rotating conductor-insulator member rotates and as an insulator portion thereof gradually covers the collector member of the switch.

FIGS. 4 and 5 show the structure of a high current repetitive switch 10 of this invention which has no significant arcing. The switch 10 comprises a stationary electric conductor member 14. Secured to the stationary electric conductor member 14 is a plurality of stems 16. The stems 16 support a base 18, as the stems 16 extend into openings 20 in the base 18. Shown above the base 18 and supported thereby is a collector 24.

Positioned above the collector 24 is a cap 30. Bolts 32 extend through openings 34 in the cap 30, and through openings 36 in the collector 24. The lower ends of the bolts 32 are positioned within openings 38 in the base 18, and the bolts 32 are threadedly attached to the base 18.

Figure 6:
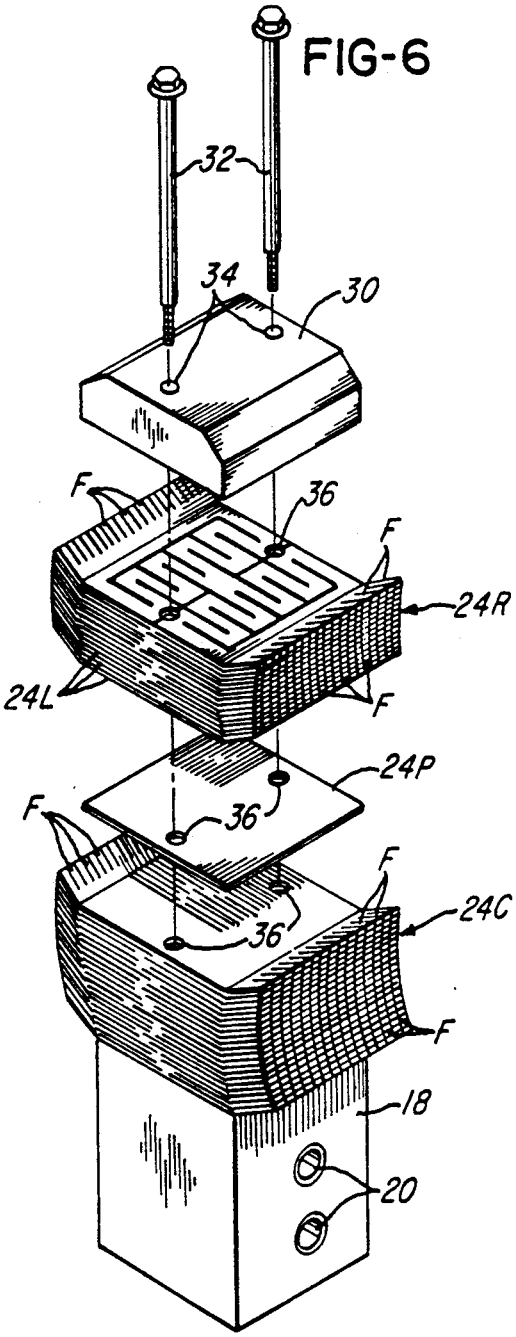
FIG. 6 is an exploded perspective view showing the construction of a collector member of a switch of this invention.
Figure 7:
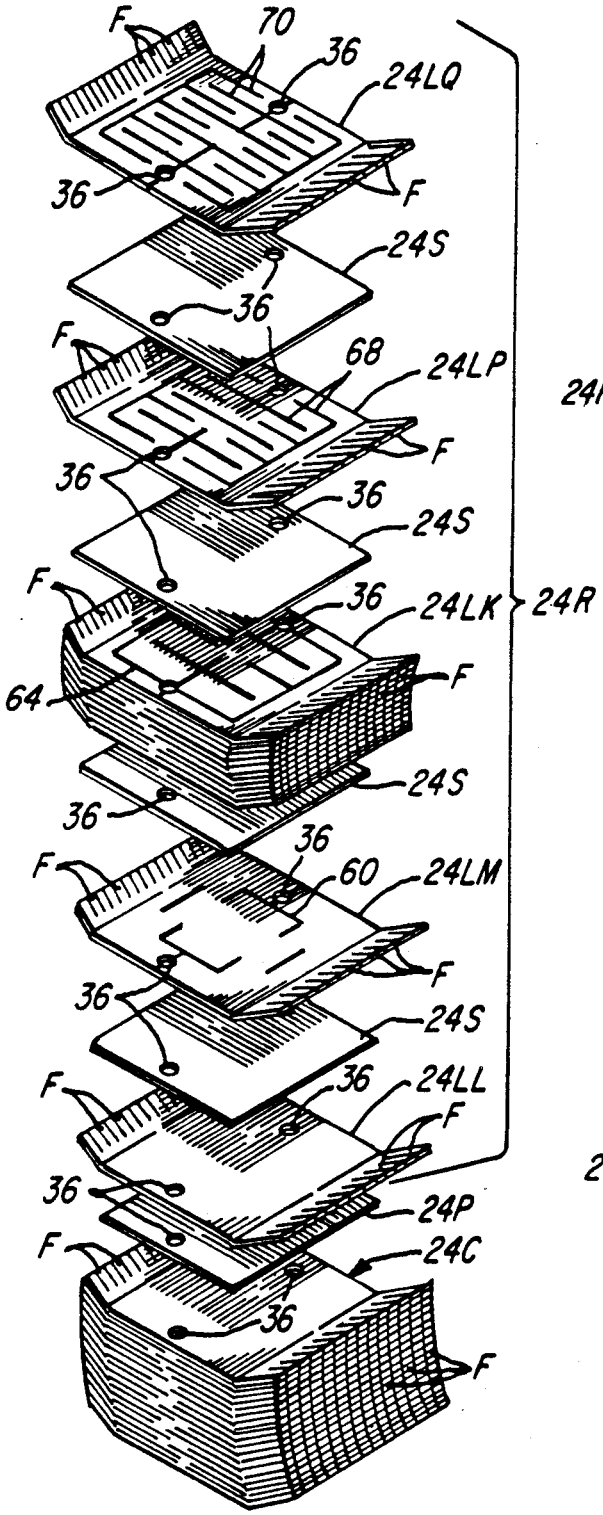
FIG. 7 is an exploded perspective view illustrating the electrical features of the structure of a collector member of a switch of this invention.

The collector 24 comprises a conductor section 24C and a resistive section 24R, as shown in FIGS. 6 and 7. Between the resistive section 24R and the conductor section 24C is a plate 24P, shown in FIGS. 6 and 7, which is, preferably, of insulator material.

The conductor section 24C comprises a stack having a multiplicity of leaves of electrically conductive material. Each of the leaves in the conductor section 24C have parallel fingers F at the ends thereof. At one end of the leaves 24C the fingers F engage a rotating conductor-insulator member 50, and at the other end thereof, the fingers F engage the stationary conductor member 14. Between adjacent leaves of the conductor section 24C is an electrically conductive spacer element, not shown. Each spacer element has a shorter length dimension than the length dimension of the leaves between which the spacer element is positioned, and each spacer element does not have fingers at the ends thereof. Thus, the fingers F of the leaves have a degree of flexibility, and each finger F has firm contact with the rotating conductor-insulator member 50 or with the stationary conductor member 14, as the fingers F engage the stationary conductor member 14 and the rotating conductor-insulator member 50. Thus, there is excellent electrical contact between the leaves and the stationary conductor member 14 and between the leaves and the rotating conductor-insulator member 50. The flat surfaces of the leaves in the conductor section 24C are electrically joined together by any suitable means, such as by soldering or the like. Thus, the conductor section 24C comprises, in effect, a single relatively large conductor member between the rotating conductor-insulator member 50 and the stationary conductor member 14.

As best shown in FIG. 7 the resistive section 24R of the collector 24 comprises a multiplicity of electrically resistive leaves 24L in a stack thereof. Between adjacent leaves 24L is an electrically insulative spacer 24S. Thus, the stack which comprises the resistive section 24R includes alternately positioned resistive leaves 24L and alternately positioned insulative spacers 24S, as best illustrated in FIG. 7. Each leaf 24L has parallel individual fingers F at one end thereof which engage the rotating conductor-insulator member 50. Each leaf 24L has parallel individual fingers F at the other end thereof which engage the stationary conductor member 14. Thus, there is excellent electrical contact between each of the resistive leaves 24L and the stationary conductor member 14, and there is excellent electrical contact between each of the leaves 24L and the rotating conductor-insulator member 50.

Due to the fact that each leaf 24L is insulated from the other leaves 24L, each leaf 24L is an individual and separate conductor-resistor between the rotating conductor-insulator member 50 and the stationary conductor member 14.

As illustrated in FIG. 7, a lower-most leaf 24LL in the stack of leaves which forms the resistive section 24R is substantially solid between the fingers F at the ends thereof. Therefore, as the fingers F are engaged by the conductive portions of the rotating conductor-insulator member 50 and by the stationary conductor member 14, there is a relatively good conductive path formed by the lowermost leaf 24LL in the resistive section 24R. In the lower part of the resistive section 24R there may be several identical leaves 24LL, each of which is separated from its adjacent leaf 24L by an insulative spacer 24S.

FIG. 7, also illustrates a leaf 24LM which is above the leaf 24LL in the stack of leaves 24L which form the resistive section 24R. The leaf 24LM has several slots 60 formed therein. The slots 60 form a longer circuitous conductive path in the leaf 24LM than the conductive path in the leaf 24LL. The slots 60 also reduce the area of electrically conductive path between the ends of the leaf 24LM. Therefore, the resistance of the leaf 24LM between the rotary conductor-insulator member 50 and the stationary conductor member 14, is greater than the resistance of the leaf 24LL. It is to be understood that in the resistive section 24R there may be several leaves which are identical in configuration to the leaf 24LM. Such leaves 24LM are positioned in stacked relationship, with an insulator member 24S between adjacent leaves 24LM.

Also, as shown in FIG. 7, positioned above the leaf 24LM is a group of resistive leaves 24LK. Each leaf 24LK has a group of slots 64 therein. The slots 64 in each leaf 24LK are greater in number and longer in length than the slots 60 in the leaf 24LM. Thus, the electrical conductive area of each leaf 24LK is less than the electrical conductive area of each leaf 24LM. Furthermore, the slots 64 in each leaf 24LK form a more circuitous conductive path within the leaf 24LK. Therefore, the resistance of each leaf 24LK is greater than the resistance of the leaf 24LM. It is to be understood that the leaves in the stack immediately below the leaf 24LK and above the leaf 24LM may be arranged in progressively greater resistance values as a result of the slot patterns therein.

Also, as shown in FIG. 7, above the leaves 24LK is a leaf 24LP. The leaf 24LP has a plurality of slots 68 therein in a desired pattern. The slots 68 are greater in number and longer than the slots 64 in each leaf 24LK. Therefore, the slots 68 form a circuitous electrical conductive path through the leaf 24LP which is longer than the electrical conductive path through the leaf 24LK. Furthermore, the electric conduction area of the leaf 24LP is less than that of each leaf 24LK. Therefore, the resistance of the leaf 24LP is greater than the resistance of the leaf 24LK.

Shown in FIG. 7 at the top of the section 24R is a leaf 24LQ. The leaf 24LQ has a large number of slots 70 therein which create a relatively long circuitous electrical conduction path through the leaf 24LQ. Therefore, the electrical resistance of the leaf 24LQ is greater than the electrical resistance of the leaves 24L in the stack below the leaf 24LQ.

OPERATION

Figure 1:
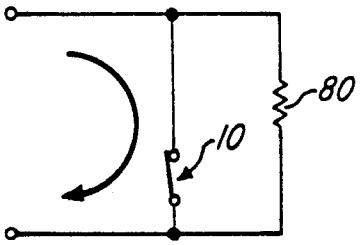
FIG. 1 is a circuit diagram illustrating flow of current through a switch of this invention when the switch is closed. This view also shows an electrical load connected in parallel with the switch.

FIG. 4 illustrates rotation of the rotating conductor-insulator member 50. In the rotative position of the rotating conductor-insulator member 50 shown in FIG. 4 the entire surface of the collector 24 is engaged by the electrically conductive surface of the rotating conductor-insulator member 50. Therefore, there is full current flow between the rotating conductor-insulator member 50 and the collector 24, and there is full current flow from the collector 24 to the stationary conductor member 14. This circuit condition is illustrated in FIG. 1. In this rotative position of the rotating conductor-insulator member 50 all of the current flow is through the switch 10, and an electrical load 80 is shorted by the switch 10.

As the rotating conductor-insulator member 50 continues to rotate, as illustrated in FIG. 5, an insulator portion 84 of the rotating conductor-insulator member 50 comes into engagement with the lower part of the collector 24. As stated and as shown, the lowest part of the collector 24 comprises the conductive section 24C. Thus, the insulator portion 84 initially blocks current flow through the conductor section 24C. As the rotating conductor-insulator member 50 continues to rotate, a greater portion of the collector 24 is engaged by the insulator portion 84. Thus, current flow through the collector 24 is forced upwardly within the collector 24.

Figure 2:
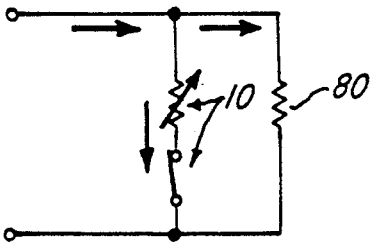
FIG. 2 is a circuit diagram, similar to FIG. 1, illustrating diagrammatically the manner in which the switch of this invention gradually increases the resistance therethrough prior to complete opening of the switch.
Figure 3:
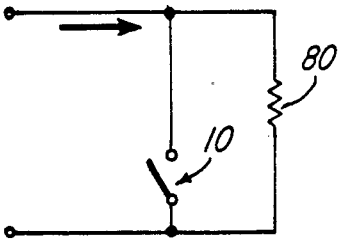
FIG. 3 is a circuit diagram, similar to FIGS. 1 and 2, illustrating current flow through the resistive load when the switch is completely open.

As the insulator portion 84 is moved upwardly, the insulator portion 84 covers all of the conductive section 24C. Then the insulator portion 84 engages leaves 24L in the resistive section 24R. The insulator portion 84 engages and covers leaves 24L which are arranged in progressively greater resistance values. This circuit condition is illustrated in FIG. 2. Due to the fact that the resistance to current flow through the resistive section 24R progressively increases as the insulator portion 84 moves upwardly, the magnitude of current flow between the rotating conductor-insulator member 50 and the collector 24 gradually decreases. The decrease in current through the collector 24 and the switch 10 progressively occurs until there is no current flow from the rotating conductor-insulator member 50 to the collector 24.

This progressive decrease in current flow between the rotating conductor-insulator member 50 and the collector 24 occurs in a manner such that there is no significant arcing between the rotating conductor-insulator member 50 and the collector 24.

Thus, it is understood that as the rotating conductor-insulator member 50 rotates and progressively engages the leaves of the collector 24 the resistance through the switch 10 is progressively increased.

As the rotating conductor-insulator member rotates, the operation of the switch 10 is repetitive. Thus, the load 80 is energized and deenergized with rotation of the rotating conductor-insulator member 50. The rotating conductor-insulator member 50 may have a plurality of insulator sections 84. When the rotating conductor-insulator member 50 has a plurality of insulator portions 84, the load 80 is energized and deenergized a plurality of times with each rotation of the rotating conductor-insulator member 50.

COOLING

Due to the fact that large magnitudes of current flow through the collector 24, means for cooling the collector 24 are included in a switch 10 of this invention.

Figure 8:
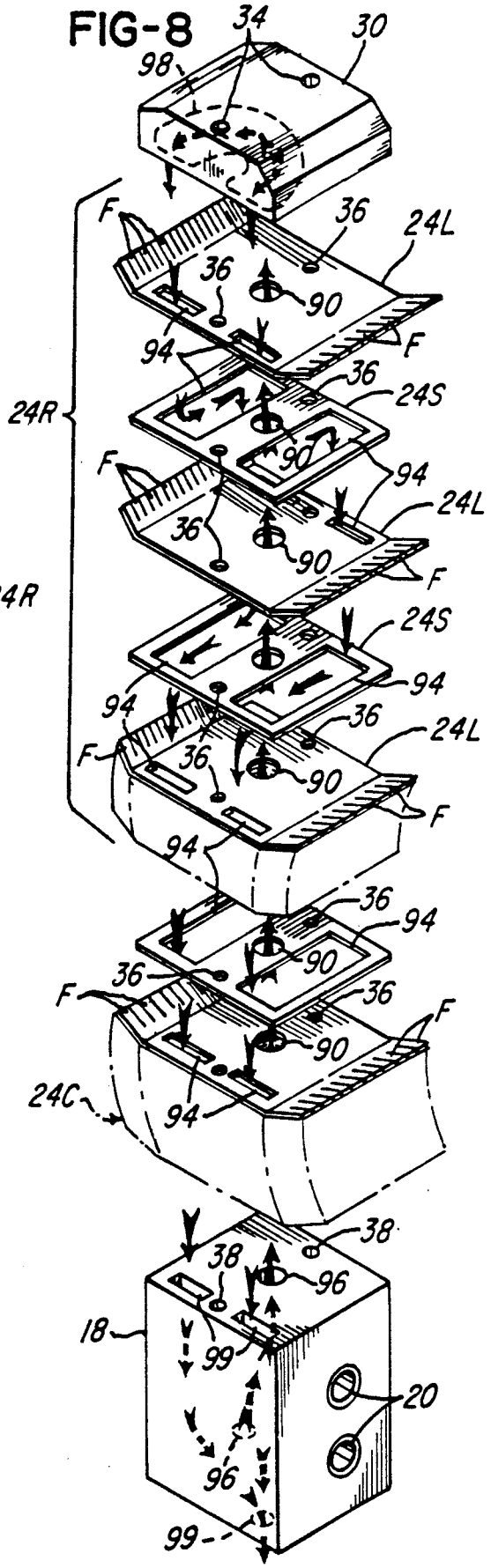
FIG. 8 is an exploded perspective view illustrating the flow paths through which cooling fluid flows in a collector member of a switch of this invention.

FIG. 8 shows fluid flow passages 90 through the central part of the leaves 24L and spacers 24S of the collector 24. FIG. 8 also shows fluid passages 94 adjacent the periphery of each leaf. Fluid enters the base 18 through a passage 96 and flows upwardly through the passage 96 and then flows through the passages 90 of the leaves. The fluid flows through a passage 98 in the cap 30 and then flows downwardly through the passages 94 in the leaves and the spacers 24S. The fluid returns to the base and flows from the base 18 through a passage 99. Thus, the collector 24 is cooled.

It is to be understood that the fluid passages 90 and 94 are present in the leaves 24L, even though these passages 90 and 94 are not shown in FIG. 7. The fluid flow structure illustrated in FIG. 8 is more readily shown in FIG. 8, without showing the slots in the leaves 24L.

Although the preferred embodiment of the high current repetitive switch of this invention has been described, it will be understood that within the purview of this invention various changes may be made in the form, details, proportion and arrangement of parts, the combination thereof, and the mode of operation, which generally stated consist in a structure within the scope of the appended claims.

The invention having thus been described, the following is claimed:

1. A high current repetitive switch comprising: a movable member including an electrically conductive section and an electrically insulative section, a collector member, a stationary conductor member, the collector member including a plurality of electrically conductive leaves, each of the leaves having a pair of opposed edge portions, each of the leaves having an edge portion in engagement with the movable member and an opposed edge portion in engagement with the stationary conductor member for conduction of electrical current between the movable member and the stationary conductor member, means electrically insulating some of the electrically conductive leaves from the other electrically conductive leaves, there being a leaf having a first electrical resistance value, there being a leaf having a second electrical resistance value, there being a leaf having a third electrical resistance value, there being a leaf having a fourth electrical resistance value, the second electrical resistance value being less than the first electrical resistance value, the third electrical resistance value being less than the second electrical resistance value, the fourth electrical resistance value being less than the third electrical resistance value, the leaves being arranged in the order of the electrical resistances thereof, the movable member moving in a direction whereby the insulative section thereof initially engages and covers the edge portion of the leaf having the fourth electrical resistance value and then progressively engages and covers the edge portion of the leaf having the third electrical resistance value and then progressively engages and covers the edge portion of the leaf having the second electrical resistance value and then progressively engages the covers the edge portion of the leaf having the first electrical resistance value, the electrically insulative portion of the movable member having an area capable of simultaneously engaging and covering all of the leaves of the collector member, whereby the current flow between the movable member and the collector member is progressively reduced to zero magnitude without significant arcing between the rotor member and the collector member, and whereby, as the movable member moves, current flow between the movable member and the collector member is interrupted and initiated.

2. The high current repetitive switch of claim 1 in which the leaf having a first resistance value has slots therethrough which form a circuitous electrically conductive path through the leaf having the first resistance value, the leaf having the second resistance value having slots therethrough which form a lesser circuitous electrically conductive path than the circuitous electrically conductive path of the leaf having the first resistance value, the leaf having the third resistance value having slots therethrough which form a lesser circuitous electrically conductive path than the circuitous electrically conductive path of the leaf having the second resistance value, the leaf having the fourth resistance value having slots therethrough which form a lesser circuitous electrically conductive path than the circuitous electrically conductive path of the leaf having the third resistance value.

3. The high current repetitive switch of claim 1 in which the movable member is a rotatable member.

4. The high current repetitive switch of claim 1 in which the electrically conductive leaf having the first electrical resistance value has slots therethrough which establish a given resistive path therethrough, and in which the electrically conductive leaf having the second electrical resistance value has slots therethrough which establish a lesser resistive path therethrough than the resistive path of the leaf having the first electrical resistance value, and in which the electrically conductive leaf having the third electrical resistance value has slots therethrough which establish a lesser resistive path therethrough than the resistive path of the leaf having the second electrical resistance value, and in which the electrically conductive leaf having the fourth electrical resistance value has slots therethrough which establish a lesser resistive path therethrough than the resistive path of the leaf having the third electrical resistance value.

5. The high current repetitive switch of claim 1 which includes a plurality of electrically conductive leaves having the first electrical resistance value, a plurality of electrically conductive leaves having the second electrical resistance value, a plurality of electrically conductive leaves having the third electrical resistance value, and a plurality of electrically conductive leaves having the fourth electrical resistance value.

6. The high current repetitive switch of claim 1 in which each of the electrically conductive leaves has a fluid flow passage therethrough for flow of cooling fluid therethrough.

7. The high current repetitive switch of claim 1 which includes an electrical insulator memberr between the leaf having the first electrical resistance value and the leaf having the second electrical resistance value, an electrical insulator member between the leaf having the second electrical resistance value and the leaf having the third electrical resistance value, and an electrical insulator member the leaf having the third electrical resistance value and the fourth electrical resistance value, whereby each of the leaves is electrically insulated from the other electrically conductive leaves.

8. A high current switch comprising a collector which includes a stack of electrically conductive leaves, there being a plurality of electrically conductive leaves in the stack thereof, each of the electrically conductive leaves in the stack thereof having a resistance value, the stack of electrically conductive leaves having an upper portion and a lower portion, the electrically conductive leaves in the stack being progressively arranged in resistance values so that each of the electrically conductive leaves has a resistance value no greater than the resistance value of the electrically conductive leaf thereabove.

9. The high current switch of claim 8 in which each of the electrically conductive leaves has an edge portion and in which the edge portion includes a plurality of finger elements.

10. The high current switch of claim 8 in which each of the electrically conductive leaves has an edge portion and in which the edge portion includes a plurality of finger elements, the switch also including a rotor member provided with an electrically conductive section and an electrically insulative section, the rotor member being in engagement with the finger elements of the edge portion of each of the electrically conductive leaves.

11. A high current switch which comprises a stack of electrically conductive leaves, each of the electrically conductive leaves having a resistance value, there being several resistance values present in the stack of electrically conductive leaves, the stack of electrically conductive leaves having an upper portion and a lower portion, the electrically conductive leaves in the stack being arranged in the stack so that each of the electrically conductive leaves in the stack has a resistance value which is no greater than the resistance value of an electrically conductive leaf thereabove, and means electrically insulating each leaf from the other leaves in the stack of electrically conductive leaves.

12. The high current switch of claim 11 in which each electrically conductive leaf is provided with a fluid flow passage therethrough for flow of cooling fluid through the electrical conductive leaf.

13. The high current switch of claim 11 in which each of the electrically conductive leaves has a plurality of openings therethrough which form a circuitous electrical conductive path through the electrically conductive leaf.

14. The high current switch of claim 11 which includes a rotor member in engagement with the stack of electrically conductive leaves, the rotor member having an electrically conductive section and an electrically insulative section, the electrically conductive section and the electrically insulative section moving sequentially in engagement with the stack of electrically conductive leaves with rotation of the rotor member.

15. The high current switch of claim 11 which includes a rotary memberr having an electrically conductive section and an electrically insulative section, and in which each of the electrically conductive leaves has a plurality of slots therethrough which form a circuitous electrical conductive path through the electrically conductive leaf; a stationary electrical conductive member, the stack of electrically conductive leaves being in engagement with the stationary electrical conductive member, the stack of electrically conductive leaves alos being in engagement with the rotary member, with the stack o f electrically conductive leaves between the rotary member and the stationary electrical conductor member.

16. The high current switch of claim 11 in which each of the electrically conductive leaves has a pluraltiy of openings therethrough which form a circuitous electrical conductive path through the electrically conductive leaf, a stationary electrical conductive member, each of the leaves having an edge portion, the edge portion of the electrically conductive leaves in the stack thereof being in engagement with the stationary electrical conductive member.

17. A high current switch comprisng a collector member, the collector member including a stack of electrically conductive flat thin member, at least one of the electrically conductive flat thin members being a first flat thin member and having a plurality of openings therethrough arranged in a given pattern, the first flat thin member thus having a given electrical resistance path, at least one of the electrically conductive flat thin members being a second flat thin member and having a plurality of openings therethrough which are arranged in a pattern different from the pattern of the openings in the first flat thin member, the second flat thin member thus having an electrical resistance path different from the electrical resistance path of the first flat thin member, at least one of the electrically conductive flat thin members being a third flat thin member and having a plurality of openings therethrough which are arranged in a pattern different from the pattern of the openings in the first flat thin member and different from the openings in the second flat thin member, the third flat thin member thus having an electrical resistance path different from the electrical resistance path of the first flat thin member and diffferent from the electrical resistance path of the second flat thin member.

18. The high current switch of claim 17 in which the openings in each electrically conductive flat thin member are slots which increase the electrical resistance path and which reduce the current carrying area of the electrically conductive flat thin member.

19. The high current switch of claim 17 which includes electrical insulator means separating each of the electrically conductive flat thin members from each of the other flat thin members.

20. The high current switch of claim 17 in which the total area of the openings in the first electrically conductive flat thin member is greater than the total area of the openings in the second electrically conductive flat thin member, and in which the total area of the openings in the second electrically conductive flat thin member is greater than the total area of the openings in the third electrically conductive flat thin member.

21. The high current switch of claim 17 in which the total area of the openings in the first electrically conductive flat thin member is greater than the total area of the openings in the second electrically conductive flat thin member, and in which the total area of the openings in the second electrically conductive flat thin member is greater than the total area of the openings in the third electrically conductive flat thin member and in which the first electrically conductive flat thin member is positioned above the second electrically conductive flat thin member, and the second electrically conductive flat thin member is positioned above the third electrically conductive flat thin member.

22. The high current switch of claim 17 which includes a rotor member in engagement with the collector member, the rotor member including an electrically conductive section and an electrically insulative section.

23. The method of energization and deenergization of a high current direct current circuit comprising providing a plurality of electrically conductive leaves having various resistance values, arranging the leaves in stack formation whereby the resistance values of the leaves in the stack have progressively greater resistance values, insulating some of the leaves from the other leaves, providing a movable member which has an electrically conductive section and an electrically insulative section, positioning the movable member in engagement with the stack of electrically conductive leaves, connecting an electrical circuit to the movable member and to the stack of electrically conductive leaves for flow of electrical current between the stack of electrically conductive leaves and the rotary member, moving the movable member whereby the electrically conductive section and electrically insulative section sequentially engage the stack of electrically conductive leaves.

24. The method of claim 23 in which the movable member which is provided is a rotary member.

25. The method of claim 23 which includes creating an opening through each of the electrically conductive leaves whereby each opening lessons the total electrical conductivity of the leaf, arranging the leaves in the stack thereof wherein a leaf having a greater electrical conductivity value is positioned below a leaf having lesser electrical conductivity value, moving the movable member so that the electrically insulative section first engages a leaf having the greates electrical conductivity value and then engages a leaf having a lesser electrical conductivity value.

26. The method of claim 23 which includes providing a plurality of electrically conductive leaves in which each leaf has a plurality of openings therethrough wherein a resistance value is created within each leaf, arranging the leaves in the stack thereof wherein each leaf having a greater resistance value is positioned above a leaf having a lesser resistance value, moving the movable member so that the electrically insulative section first engages a leaf having the least resistance value and then progressively engages leaves having greater resistance values.

* * * * *